US011401893B1

(12) United States Patent
Chausse

(10) Patent No.: US 11,401,893 B1
(45) Date of Patent: Aug. 2, 2022

(54) APPARATUS WITH ACTIVE PREFILTER FOR FLUID OXIDANT FOR ANY TYPE OF COMBUSTION AND DEVICE USING AN OXIDANT

(71) Applicant: ECOPRA, Dore-l'Église (FR)

(72) Inventor: Christophe Chausse, Dore l'Église (FR)

(73) Assignee: ECOPRA, Dore-l'Église (FR)

( * ) Notice: Subject to any disclaimer, the term of this patent is extended or adjusted under 35 U.S.C. 154(b) by 0 days.

(21) Appl. No.: 17/506,615

(22) Filed: Oct. 20, 2021

(30) Foreign Application Priority Data

Mar. 27, 2021 (FR) ..... 21 03140

(51) Int. Cl.
*F02M 27/04* (2006.01)

(52) U.S. Cl.
CPC ..... *F02M 27/04* (2013.01)

(58) Field of Classification Search
CPC . F02M 27/04; F02M 27/045; F02M 2027/047
See application file for complete search history.

(56) References Cited

U.S. PATENT DOCUMENTS 4,320,003 A * 3/1982 Sanderson ..... C02F 1/481 210/222
4,357,237 A * 11/1982 Sanderson ..... C02F 1/481 123/590
4,372,852 A * 2/1983 Kovacs ..... B01J 19/087 210/222
4,716,024 A * 12/1987 Pera ..... F02M 27/045 422/186.01
5,271,369 A * 12/1993 Melendrez ..... F02B 51/04 123/538
5,487,370 A * 1/1996 Miyazaki ..... F02M 27/045 123/538
6,024,073 A * 2/2000 Butt ..... F02M 27/02 123/538
6,325,942 B1 * 12/2001 Freije, III ..... C02F 1/482 210/695
6,684,824 B2 * 2/2004 Higa ..... F02M 27/02 123/3
10,787,958 B2 * 9/2020 Pimentel ..... F02M 27/045

* cited by examiner

*Primary Examiner* — Hung Q Nguyen
(74) *Attorney, Agent, or Firm* — Im IP Law; Chai Im; C. Andrew Im

(57) ABSTRACT

An air pre-treatment device to reduce the consumption of fuel of an engine or of a boiler by optimizing the characteristics of the oxidant thereof, i.e., of the ambient air and the moisture level thereof. The formatting chamber is defined by a pipe including homogenization members embedded in a lattice of magnetic or ferromagnetic fibers. The homogenization members include a central longitudinal axis made from magnetic or ferromagnetic material, and provided with the magnetic elements. The magnetic elements are disposed along the central longitudinal axis in field opposition and in alternation with ceramic elements. Thus, it is possible to optimize the oxidant of an engine, i.e., the ambient air passing through the formatting chamber with a frequency and coercive field induced by the magnetic elements, as well as concentrating the molecules of water at the ceramic elements.

10 Claims, 2 Drawing Sheets

APPARATUS WITH ACTIVE PREFILTER FOR FLUID OXIDANT FOR ANY TYPE OF COMBUSTION AND DEVICE USING AN OXIDANT

RELATED APPLICATIONS

This application claims priority from French Patent Application No. 21 03140 filed Mar. 27, 2021, which is incorporated herein by reference in its entirety.

FIELD OF THE INVENTION

The invention relates to a device for pre-treating oxidant upstream of injection thereof into the inlet of an internal combustion apparatus. It also relates to a vehicle equipped with such a device as well as the internal combustion boilers provided with a conveyance of the oxidant to the air filter particular to the engine and to the boiler and/or furnace. This device can be used with any type of thermal engine, also referred to as an internal combustion engine, as well as internal combustion boilers.

BACKGROUND OF THE INVENTION

An internal combustion engine and boiler use the reaction of a fuel and of an oxidant, the latter generally being the oxygen of the air and a certain moisture level, to transform the thermal energy produced by the combustion reaction into mechanical work or a manufacture of energy. Fuel means here a fuel derived from petroleum products, for example petrol, unleaded petrol, gas oil or a fuel belonging to the category of biofuels or biomass, for example a vegetable oil or an alcohol or a so-called biomass wood. Oxidant means a substance that has the property of allowing combustion of a fuel.

In internal combustion engines and boilers, the thermal energy is provided by the combustion of a fuel in liquid or solid form in the presence of a gaseous oxidant, the oxygen from the air. The gas resulting from this combustion is used, in an expansion phase, to move mechanical parts situated for example in a vehicle, a pump, a compressor or in other appliances producing a movement and energy as a general rule. In a boiler, the combustion serves to produce thermal energy which can also be transformed into other energy (electrical for example). The products, in gaseous form, resulting from the combustion, are discharged outside the engine onto the public highway in general. Because of current anti-pollution standards and because petroleum products are becoming more rare, it is advantageous to limit the gaseous discharges resulting from the combustion in such engines while improving efficiency through the quality of the combustion and the fuel consumption of these engines and boilers.

With an improved, and therefore more complete, combustion, there are fewer unburnt particles, which are potentially polluting, obtained in the exhaust gas at the discharge from the engine and boiler while having, for equal power supplied by the engine, a lower fuel consumption. This is because it is accepted that, in the exhaust gases, the proportion of unburnt fuel is generally between 0.2% and 2% of the volume of fuel injected into the engine. Moreover, some of the thermal energy released during the combustion is used for bringing the fuel and oxygen to temperature. With more complete combustion, the efficiency of the engine is optimised, the fuel consumption is reduced and the pollution of the oxidant, that is to say of the air, is decreased. For this purpose, at least partially circulating the exhaust gases in the engine by redirecting them to the air inlet system of the engine is known. This part of the exhaust gases, also known by the term "EGR gases", is thus mixed with the external air entering the engine at the inlet, which ensures combustion of some of the unburnt particles present in the exhaust gases. In this way the internal combustion efficiency of the engine and the fuel consumption are improved and the pollution emitted by the engine and the boiler on the oxidant (the air) is reduced.

It is also known that the oxidant is the element that is most consumed during combustion by an internal combustion engine, whether by mass or by volume. Thus, the various known stoichiometric ratios being: for diesel 1 gram of gas oil requires at least 15 grams of air. For petrol 1 gram of fuel requires approximately 17 grams of air. For ethanol: 1 gram of fuel requires approximately 9 grams of air. For fuel of the LPG type, the ratio is 16 grams of air for 1 gram of gas, for hydrogen 1 gram for 30 grams of air, it is known that the average humidity in the air is 70%, which implies the presence of a water molecule is 1 gram of water for 10 grams of air.

It is moreover known that refined fuel can increase the efficiency of an internal combustion engine. Injecting water into the air and exhaust gas mixture is also known. In this way the combustion temperature of the fuel/oxidant mixture is lowered and the emission of certain pollutants is limited, in particular NOx or nitrogen oxides such as NO (nitrogen oxide) or $NO_2$ (nitrogen dioxide). These pollutants combine with the water to form certain compounds, such as nitric acid. Adding water while reducing the temperature of the combustion preserves the components of the engine, by preventing overheating of the latter, while limiting the thermal energy requirements necessary for bringing the fuel/oxidant mixture to combustion temperature.

The international application WO2012080511 A1 describes a device allowing both the recirculation of gases and injection of this moist gas into a chamber in the form of a semi-rigid S. FR2783605 discloses a method comprising the step of placing a substance 1 in a region 2, 3 subjected to a specific excitation field of an electrical, magnetic and/or electromagnetic nature WO2019218089 and WO2020069559 Lability of molecules. FR 2895461-A describes a device allowing both recirculation of the exhaust gases and injection of water into the air inlet circuit of an engine. In this device, the conduits for recirculation of the gases and water are concentric and a plurality of water pipes are inserted into a gas conduit. The combustion gases are taken off on the exhaust, for example by means of a valve. The mixed water and gas are reinjected at the air inlet device of the engine. FR 2926606-A also describes a device where the exhaust gases are mixed with water prior to their injection into the inlet circuit of the engine. This device includes means for emitting electromagnetic fields acting on the gas/water mixture, prior to admission thereof into the engine. These devices are bulky and cannot easily be installed on any type of engine. Moreover, these devices do not provide optimum homogenization of the water and exhaust-gas mixture before injection thereof into the inlet circuit of the engine.

OBJECT AND SUMMARY OF THE INVENTION

Considering the drawbacks of the prior art, the present invention proposes a device for pre-treating oxidant of an engine, said oxidant being composed of a mixture of the gases and water present in the ambient air, and include a formatting chamber incorporating means for emitting magnetic fields and ceramics positioned alternately and disposed so as to cause a particular frequency in the chamber for treating the air, and for optimizing the moisture level thereof prior to admission thereof into the engine. The device of the invention thus makes it possible to treat the oxidant by a mechanical treatment that does not consume energy, it is easy to implement, and provides formatting of the air adaptable to various types of engine and boiler.

To this end, the invention proposes a device for pretreating air for an engine or boiler including a formatting chamber including a pipe incorporating homogenization members embedded in a lattice of magnetic or ferromagnetic fibers, said homogenization members comprising:

a central longitudinal axis made from magnetic or ferromagnetic material provided with magnetic elements, characterized in that:

said magnetic elements are disposed along the central axis in field opposition and in alternation with ceramic elements.

According to advantageous but non-obligatory aspects of the invention, the device may incorporate one or more of the following features, in any technically operable combination:

The pipe is defined by a metal pipe including an internal sheath made from non-magnetic material, such as a stainless steel braid provided with a flexible hose.

The central axis is composed of a ferromagnetic core, such as a steel stranded cable.

The central axis is composed of a magnetic core defined by a magnetic metal braid making it possible to design a formatting chamber for large volumes of air.

The magnetic elements are disposed in said chamber to act on a set of ferromagnetic or magnetic materials of the device.

The formatting chamber includes inlet and outlet connections, and wherein a diameter of the pipe of the formatting chamber is greater than a diameter of the inlet and outlet connections, thus creating a chamber for tranquilizing the flow of air, optimizing the homogenization and formatting of the oxidant.

The device also includes an air-inlet pipe connected firstly to an air-collection member and secondly to an inlet of the formatting chamber, and an air-outlet pipe connected firstly to an outlet of the formatting chamber and secondly intended to be connected to an engine. These elements allow easy positioning according to the space available at the air primary collector, while facilitating maintenance and changing of these various members.

The invention also relates to an engine and a boiler equipped with a device according to one of the above features.

BRIEF DESCRIPTION OF THE DRAWINGS

The invention will be better understood and other advantages thereof will emerge more clearly from a reading of the following description of two embodiments of a device according to the invention, given solely by way of examples and with reference to the accompanying drawings, wherein.

DETAILED DESCRIPTION OF THE EMBODIMENTS

The present invention proposes an air-pretreatment device for reducing the consumption of fuel of an engine or of a boiler while optimizing the characteristics of its oxidant, that is to say of the ambient air and its moisture level. The device of the invention also makes it possible to filter the particles in suspension and to reduce the polluting emissions of a combustion engine. Empirically, the device of the invention makes it possible to reduce the fuel consumption by approximately 22%, to reduce the polluting emissions by at least 20% and to reduce the noise nuisance of the engines by 3 and up to 8 decibels.

Figure 1:
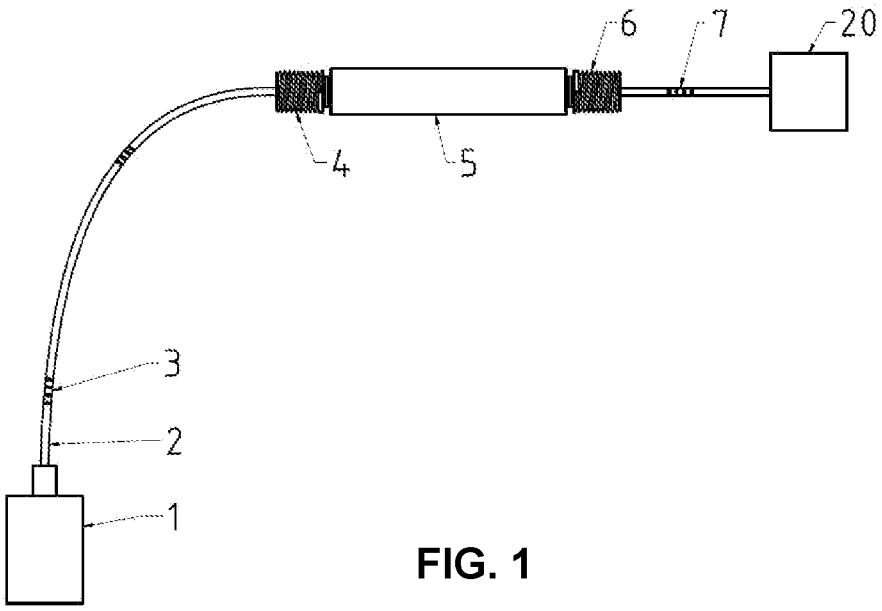
FIG. 1 is a schematic representation of a device according to the invention including connection elements and inlet and outlet members.

For this purpose, the device includes a formatting chamber intended to receive oxidant upstream to the injection thereof to the engine. FIG. 1 illustrates a representation of the formatting chamber and installation accessories and optionally filtration accessories, including a first air-collection member 2. This member 2, illustrated schematically, has a form and dimensions adapted to the outlet of a pipe with a simple filter, for example an engine equipping an automotive vehicle or a boiler. Automotive vehicle here designates not only a car but also a lorry, a motorbike, a scooter, an agricultural machine, a site machine or a boat. Boiler means any type of furnace for combustion of a gas, biomass or product derived from petroleum product. Advantageously, the member 2 is produced from incorruptible metal material, for example stainless steel, and is adapted for collecting air. For this purpose, the member 2 is advantageously positioned in the common direction of circulation in forward travel of the vehicle. Such a member is maintained in this position by means known per se, for example with collars making it possible to avoid any vibration of the device. The member 2 is for example a cannula or stainless steel aviation braid flexible metal tube, or rigid tube, made from non-magnetic stainless steel.

The member 2 makes it possible to take off part of the air and its moisture level in the environment close to the device. Preferably, the member 2 is provided with a simple filter in the grille for example of the vehicle or in the environment of the furnace. The quantity of gas and air taken off depends on the amount of the negative pressure of inlet air demanded by the engine 20, i.e., on the work demanded of the engine or by a boiler. The member 2 is in this embodiment connected by a tube 3, illustrated schematically in FIG. 1, to the member 2. The tube 3 is produced from a material insensitive to the environmental conditions and resistant to heat; it is for example a flexible or rigid metal tube 3, made from stainless steel, the dimensions and size of which are adapted to the conditions of assembly of the device in the environment of the engine or of a boiler and its air inlet circuit.

An air inlet end 1, located in the direction of travel or in the environment of the tube 3, is attached to the outlet of the member 2 and the other end is attached to an inlet connection 4 of the formatting chamber 5. A transfer cannula 7 is connected to an outlet connection 6 of the formatting chamber. Advantageously, the tube 3 is mounted removably, for example by threaded rings, on the cannula 7 and on the outlet of the member 2.

Figure 5:
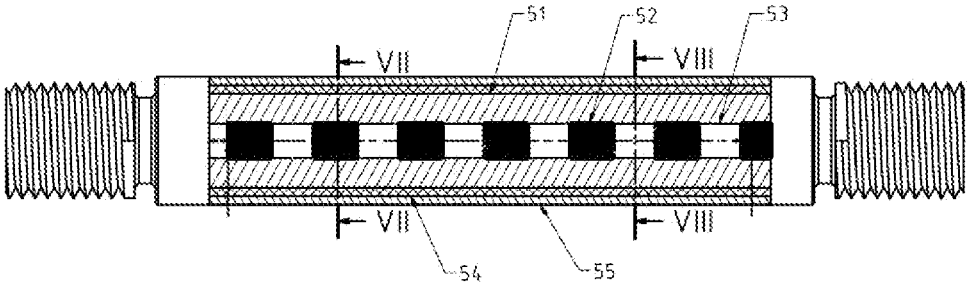
FIG. 5 is a schematic representation of a longitudinal section of the formatting chamber according to a first embodiment of the device of the invention.
Figure 6:
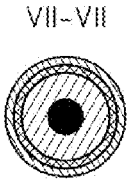
FIG. 6 is a cross section of FIG. 5 along the line VII-VII.
Figure 7:
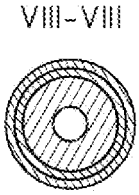
FIG. 7 is a cross section of FIG. 5 along the line VIII-VIII.

According to the present invention, the formatting chamber 5 (FIGS. 2 and 5) is defined by a pipe 55 including homogenization members embedded in a lattice of the magnetic or ferromagnetic fibers 52. In particular, the homogenization members comprise a central longitudinal axis 51 made from magnetic or ferromagnetic material, and being provided with the magnetic elements 53. Advantageously, said magnetic elements are disposed along the central axis 51 in field opposition and in alternation with ceramic elements 52. It is thus possible to optimize the oxidant of an engine, i.e., the ambient air passing through the formatting chamber with a frequency and coercive field induced by the magnetic elements, as well as concentrating the water molecules at the ceramic elements. In addition, incorporating ceramic elements inside the formatting chamber makes it possible to reduce the number of elements necessary for optimizing the oxidant, by eliminating the need for a water-injection device. Installing the formatting chamber is also facilitated, requiring only simple connections for being connected to the engine.

This is because the applicants have observed that incorporating the ceramic elements alternating with the magnetic elements in the homogenization chamber optimizes the water composition of the oxidant, without the need for an additional injection of water. This alternating composition of ceramics appears to filter the water, to homogenize the moisture level and to dynamize the water molecules by probably acting on its intermolecular structuring. In one embodiment, the ceramic elements are selected from ceramic beads typically used in the treatment of potable water, for example ceramics produced from clay fermented with microorganisms that are effective anaerobically, put in the form of hollow cylinders and following baking at 1200-1300° C. in a reducing atmosphere. In another embodiment, the ceramics are selected from ceramic beads for insulating electric cables produced for example from steatite.

Figure 2:
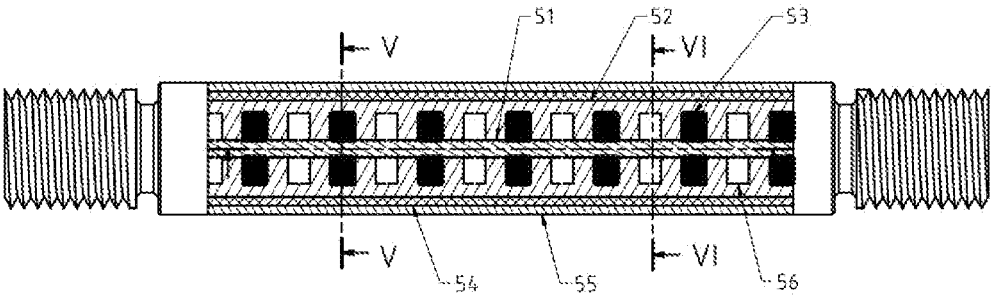
FIG. 2 is a schematic representation of a longitudinal section of the formatting chamber according to a first embodiment of the device of the invention.
Figure 3:
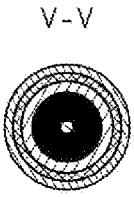
FIG. 3 is a cross section of FIG. 2 along the line V-V.
Figure 4:
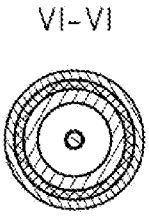
FIG. 4 is a cross section of FIG. 2 along the line VI-VI.

According to an embodiment illustrated in FIG. 2, the formatting chamber 5 is configured as a stainless steel braid provided with non-magnetic shielding able to balance the pressure in the chamber. It is located in proximity to the inlet 20, the tube 3 then having a minimum length to be free for acquiring air. In another embodiment, the distance between the two chamber connection points 2, 4 depends on the mounting conditions of the device and the space available in the vicinity of the engine. The chamber 4 is also distant from the member 2. The formatting chamber comprises an internal sheath 54 made from non-magnetic material, such as a flexible hose 54.

The function of the formatting chamber 5 is to provide optimum formatting for the air and the moisture level. In other words, this mixture is formatted before injection thereof into the air filter particular to the engine. This formatting chamber 5 is also adapted for allowing the filtration of certain finest particles that can pass through the air inlet circuit before the air filter of the engine, and combustion thereof. The homogenization member 52 comprises a lattice of fibers 52 applied in the form of a ferromagnetic ribbon and is composed of a ferromagnetic core.

The passage makes it possible to format the air before admission thereof into the air filter particular to the engine. The formatting chamber 5 is flexible and has the non-exhaustive overall form of a tube. Such a flexible form makes it possible to position it in the engine compartment against an element located in the vicinity of the engine, in order to facilitate the attachment of the device while minimizing the space requirement for the whole of the device. Attaching the formatting chamber 5 is facilitated by a flexibility due to the composition thereof. This chamber is for example a stainless steel flexible hose, a known industrial product.

The formatting chamber 5 has a tubular (non-exhaustive) and flexible form, so as to define a line of air travel inside the formatting chamber 5, between the inlet 4 and the outlet of the chamber 6. It should be noted that, on installation, the chamber 5 does not have an installation direction. In a variant, the formatted oxidant is admitted directly in the collecting tube of the inlet before the air filter of the engine and without passing through a transfer cannula.

As illustrated in FIG. 2, homogenization members 51, 52, 53 and 56 are inserted in a central position in the formatting chamber 5 and include:

- a central axis 51 made from ferromagnetic material such as a steel stranded cable;
- a lattice of water-repellent magnetic or non-magnetic fibers 52 such as a covering and water-repellent ferrous textile ribbon, for example a stainless steel wool;
- magnetic elements 53 such as magnets in the form of rings mounted on said central axis 51; and
- ceramic elements 56 mounted on the central axis in alternation with the magnetic elements.

Alternatively, the central axis 51 may be produced by means of a textile braid made from ferromagnetic material, such as a stainless steel braid. Optionally, the central axis may be offset towards one of the walls of the pipe and have a rectilinear or non-rectilinear form.

The homogenization members provide homogenization of the air over the whole of the travel of the latter between the inlet 4 and the outlet 6 of the chamber 5. These members also act as a member for filtering the mixture and forcing said formatting effect by friction and magnetization effect. This thus achieves a turbulent flow, a friction and a formatting of the air and the moisture level thereof, due to the configuration of the formatting chamber 5 and to the presence of an obstacle, namely the homogenization members 51, 52, 53, 56. A filtration of the mixture is also ensured, by retaining certain particles according to the sizes thereof by means of the lattice of fibers 52.

Moreover, the presence of a magnetic field through the magnetic elements 53 (neodymium or ferrite magnetic elements in field opposition distributed in a definite fashion) has an influence on the orientation of the constituents of the mixture when they pass through the formatting chamber 5. Through the presence of a magnetic field, the risk of the particles sticking on the walls of the chamber 5, which could cause a reduction in the useful volume of the chamber, or even blocking thereof, is limited.

The formatting chamber 5 thus provides homogeneous stirring of the air and of its moisture level, as well as filtration thereof, while limiting the quantity of particles sent into the inlet chamber before the air filter particular to the engine.

In another implementation of installation of the device, the cannula 2 supplies the formatting chamber 5. The air is then supplied through the cannula 2. This cannula 2 may be inserted at the front of the vehicle on the grille for collecting air. It may be provided with an air filter particular to this cannula in order to prefilter the oxidant. This other embodiment allows installation in the direct environment of the engine and thus the formatting chamber 5 through its advantageous form is placed in the environment of the engine.

Such a device is relatively simple to implement and mounting is easy on any type of engine, in particular when they equip a vehicle, since no particular conversion of the vehicle is necessary, the termination of the circuit being before or in the air filter. The device is mounted inside or before the air filter, and at the periphery of the engine of the automotive vehicle its space requirement is minimal and it is fixed removably to the vehicle since it does not require any particular conversion of the vehicle. The purpose of this mounting is to subject the assembly to the known phenomenon of negative pressure of the operation of an engine and of a boiler on acquisition of the oxidant of the air and the moisture level in an atmosphere.

Moreover, the elements of the device can be positioned at different angles, the supply being optimum whatever the position of the formatting chamber 5 with respect to the horizontal. In a variant, the formatting chamber 5 is produced in multiple chambers. For example, the formatting chamber is composed of a plurality of chambers to treat a larger quantity of air and to have a zigzag travel of variable length. The invention also proposes a vehicle equipped with such a device as well as internal combustion boilers provided with a conveying of oxidant to the air filter particular to the engine and to the boiler and/or furnace.

This device can be used with any type of thermal engine, also referred to as an internal combustion engine, as well as internal combustion boilers.

The invention claimed is:

1. Air pre-treatment device for an engine, comprising a formatting chamber comprising a pipe incorporating homogenization members embedded in a lattice of magnetic or ferromagnetic fibers, the homogenization members comprising a central longitudinal axis made from magnetic or ferromagnetic material provided with magnetic elements, wherein the magnetic elements are disposed along the central longitudinal axis in field opposition and in alternation with ceramic elements.

2. The device of claim 1, wherein the pipe is defined by a metal pipe comprising an internal sheath made from non-magnetic material.

3. The device of claim 2, wherein the internal sheath is made of a stainless steel braid provided with a hose.

4. The device of claim 1, wherein the central longitudinal axis is composed of a ferromagnetic core.

5. The device of claim 4, wherein the ferromagnetic core is a stranded cable made from steel.

6. The device of claim 1, wherein the central longitudinal axis is composed of a magnetic core defined by a magnetic metallic braid.

7. The device of claim 1, wherein the magnetic elements are disposed in the formatting chamber to act on a set of said ferromagnetic or magnetic materials of the air pre-treatment device.

8. The device of claim 1, wherein the formatting chamber comprises input and output connections; and wherein a diameter of the pipe of the formatting chamber is greater than a diameter of the input and output connections.

9. The device of claim 1, further comprising an air-inlet pipe connected firstly to an air-collection member and secondly to an inlet of the formatting chamber; and an air-outlet pipe connected firstly to an outlet of the formatting chamber and secondly configured to be connected to the engine.

10. An engine or boiler equipped with the air pre-treatment device of claim 1.

* * * * *